US009970166B2

(12) United States Patent
Aston et al.

(10) Patent No.: US 9,970,166 B2
(45) Date of Patent: May 15, 2018

(54) CONCRETE BRIDGE SYSTEM AND RELATED METHODS

(71) Applicants: Scott D. Aston, Liberty Township, OH (US); Michael G. Carfagno, Dayton, OH (US); Philip A. Creamer, Springboro, OH (US)

(72) Inventors: Scott D. Aston, Liberty Township, OH (US); Michael G. Carfagno, Dayton, OH (US); Philip A. Creamer, Springboro, OH (US)

(73) Assignee: CONTECH ENGINEERED SOLUTIONS LLC, West Chester, OH (US)

( * ) Notice: Subject to any disclaimer, the term of this patent is extended or adjusted under 35 U.S.C. 154(b) by 548 days.

(21) Appl. No.: 14/223,616

(22) Filed: Mar. 24, 2014

(65) Prior Publication Data

US 2014/0241805 A1 Aug. 28, 2014

Related U.S. Application Data

(60) Continuation-in-part of application No. 13/946,500, filed on Jul. 19, 2013, now abandoned, which is a division of application No. 13/756,910, filed on Feb. 1, 2013, now Pat. No. 8,523,486.

(60) Provisional application No. 61/811,905, filed on Apr. 15, 2013, provisional application No. 61/595,404, filed on Feb. 6, 2012, provisional application No. 61/598,672, filed on Feb. 14, 2012, provisional application No. 61/714,323, filed on Oct. 16, 2012.

(51) Int. Cl.
*E01F 5/00* (2006.01)
*B28B 7/02* (2006.01)

(52) U.S. Cl.
CPC ..... *E01F 5/005* (2013.01); *B28B 7/02* (2013.01)

(58) Field of Classification Search
USPC ..... 405/124–126, 43–49
See application file for complete search history.

(56) References Cited

U.S. PATENT DOCUMENTS

| | | | |
|---|---|---|---|
| 109,886 | A | 12/1870 | Freeman |
| 567,653 | A | 9/1896 | Parker |
| 701,034 | A | 5/1902 | Gray |
| 832,017 | A | 9/1906 | Hummel |

(Continued)

FOREIGN PATENT DOCUMENTS

| | | |
|---|---|---|
| EP | 0244890 | 11/1987 |
| EP | 0568799 | 11/1993 |

(Continued)

OTHER PUBLICATIONS

Written Opinion of the International Searching Authority, International Application No. PCT/US2014/033459, dated Aug. 27, 2014, 8 pages.

(Continued)

*Primary Examiner* — Thomas B Will
*Assistant Examiner* — Katherine J Chu
(74) *Attorney, Agent, or Firm* — Thompson Hine LLP

(57) ABSTRACT

A concrete culvert assembly includes multiple culvert units forming multiple side-by-side channels. One or more of the side-by-side channels have an interior side that is substantially vertical and an exterior side that is outwardly angled from top to bottom.

13 Claims, 14 Drawing Sheets

(56) References Cited

U.S. PATENT DOCUMENTS

| | | | | |
|---|---|---|---|---|
| 1,013,440 | A | 1/1912 | Rankin | |
| 1,040,442 | A | 10/1912 | Shannon | |
| 1,074,268 | A | 9/1913 | Kelly et al. | |
| 1,184,634 | A | 5/1916 | Duerswachter | |
| 1,219,434 | A | 3/1917 | Burkholder | |
| 1,332,243 | A | 3/1920 | Whalen | |
| 1,474,808 | A | 11/1923 | Zucco | |
| 1,734,392 | A | 11/1929 | Moore | |
| 1,784,271 | A | 12/1930 | Collins | |
| 2,616,149 | A | 11/1952 | Waller | |
| 2,686,421 | A | 8/1954 | Barron | |
| 3,195,852 | A | 7/1965 | Lundell | |
| 3,286,972 | A | 11/1966 | Jackson | |
| 3,397,494 | A | 8/1968 | Waring | |
| 3,848,377 | A | 11/1974 | Mori | |
| D241,634 | S | 9/1976 | Nickerson | |
| 4,094,110 | A | 6/1978 | Dickens et al. | |
| 4,099,360 | A | 7/1978 | Outram | |
| 4,141,666 | A | 2/1979 | DeGraff | |
| 4,211,504 | A | 7/1980 | Sivachenko | |
| 4,314,755 | A | 2/1982 | Johnson | |
| 4,314,775 | A | 2/1982 | Johnson | |
| 4,318,635 | A | 3/1982 | Gurtner et al. | |
| 4,558,969 | A | 12/1985 | FitzSimons | |
| 4,563,107 | A | 1/1986 | Peterson | |
| 4,564,313 | A * | 1/1986 | Niswander et al. | 405/125 |
| 4,587,684 | A | 5/1986 | Miller | |
| 4,650,369 | A | 3/1987 | Thomas | |
| 4,687,371 | A | 8/1987 | Lockwood | |
| 4,693,634 | A | 9/1987 | Chiaves | |
| 4,723,871 | A | 2/1988 | Roscoe | |
| 4,797,030 | A | 1/1989 | Lockwood | |
| 4,817,353 | A | 4/1989 | Woods et al. | |
| 4,854,775 | A | 8/1989 | Lockwood | |
| 4,972,641 | A | 11/1990 | Barrios | |
| 4,972,646 | A | 11/1990 | Miller et al. | |
| 4,987,707 | A | 1/1991 | Kiselev et al. | |
| 4,993,872 | A | 2/1991 | Lockwood | |
| 5,252,002 | A | 10/1993 | Day | |
| 5,326,191 | A | 7/1994 | Wilson et al. | |
| D356,163 | S | 3/1995 | Ryan | |
| 5,384,997 | A | 5/1995 | McClinton | |
| 5,505,033 | A | 4/1996 | Matsuo et al. | |
| 5,524,405 | A | 6/1996 | Byrd | |
| 5,533,835 | A | 7/1996 | Angelette | |
| 5,536,113 | A | 7/1996 | McGregor | |
| 5,586,417 | A | 12/1996 | Henderson et al. | |
| D380,278 | S | 6/1997 | Cote | |
| 5,590,433 | A | 7/1997 | Fricke | |
| 5,720,577 | A | 2/1998 | Sanders et al. | |
| 5,836,717 | A | 11/1998 | Bernini | |
| D406,364 | S | 3/1999 | Robert | |
| D406,902 | S | 3/1999 | Lockwood | |
| D426,321 | S | 6/2000 | Lockwood | |
| 6,094,881 | A | 8/2000 | Lockwood | |
| 6,129,484 | A | 10/2000 | Chiaves | |
| 6,161,342 | A | 12/2000 | Barbier et al. | |
| 6,205,605 | B1 | 3/2001 | Orsat | |
| 6,205,717 | B1 | 3/2001 | Shall et al. | |
| 6,243,994 | B1 * | 6/2001 | Bernini | 52/86 |
| 6,367,214 | B1 | 4/2002 | Monachino | |
| 6,408,581 | B2 | 6/2002 | Monachino | |
| 6,474,907 | B2 | 11/2002 | Semotiuk | |
| D471,989 | S | 3/2003 | Van Gilst | |
| 6,640,505 | B1 | 11/2003 | Heierli | |
| D484,609 | S | 12/2003 | Harrington | |
| D484,610 | S | 12/2003 | Lockwood | |
| D487,778 | S | 3/2004 | Kahlig | |
| 6,719,492 | B1 | 4/2004 | Heierli | |
| D490,533 | S | 5/2004 | Lockwood | |
| 6,854,928 | B2 | 2/2005 | Lockwood | |
| 6,922,950 | B2 | 8/2005 | Heierli | |
| D511,215 | S | 11/2005 | Vaia | |
| D511,387 | S | 11/2005 | Beach | |
| 6,962,465 | B2 | 11/2005 | Zax et al. | |
| D512,513 | S | 12/2005 | Wasniak et al. | |
| 6,988,337 | B1 | 1/2006 | Heierli | |
| D514,706 | S | 2/2006 | Beach | |
| 7,001,110 | B2 | 2/2006 | Lockwood | |
| 7,114,305 | B2 | 10/2006 | Heierli | |
| 7,217,064 | B1 | 5/2007 | Wilson | |
| 7,305,798 | B1 | 12/2007 | Heierli | |
| D566,852 | S | 4/2008 | Gaster | |
| D573,722 | S | 7/2008 | Lockwood | |
| 7,556,451 | B2 | 7/2009 | Beach et al. | |
| 7,568,860 | B2 | 8/2009 | Chiaves | |
| 7,572,084 | B2 | 8/2009 | Robertson | |
| 7,770,250 | B2 | 8/2010 | Boresi et al. | |
| D645,572 | S | 9/2011 | Von Handorf | |
| D658,976 | S | 5/2012 | Morrow, Jr. | |
| 8,523,486 | B2 | 9/2013 | Aston et al. | |
| 8,672,583 | B1 * | 3/2014 | Mailhot et al. | 405/46 |
| 8,789,337 | B2 * | 7/2014 | Aston et al. | 52/742.1 |
| 2005/0123354 | A1 | 6/2005 | Zax et al. | |
| 2006/0174549 | A1 | 8/2006 | Dagher et al. | |
| 2006/0201091 | A1 | 9/2006 | Lockwood | |
| 2007/0098503 | A1 | 5/2007 | Vaia | |
| 2009/0183321 | A1 | 7/2009 | Bores et al. | |

FOREIGN PATENT DOCUMENTS

| | | |
|---|---|---|
| FR | 2330818 | 6/1977 |
| WO | WO 1992/007144 | 4/1992 |

OTHER PUBLICATIONS

International Search Report, dated Apr. 5, 2013, PCT/US2013/023999, filed Jan. 31, 2013.

Written Opinion of the International Searching Authority, dated Apr. 5, 2013, PCT/US2013/023999, filed Jan. 13, 2013.

Non-Final Office Action, dated Feb. 28, 2014, U.S. Appl. No. 13/946,500, filed Jul. 19, 2014, 9 pages.

* cited by examiner

CONCRETE BRIDGE SYSTEM AND RELATED METHODS

CROSS-REFERENCES

This application claims the benefit of U.S. Provisional Application Ser. No. 61/811,905, filed Apr. 15, 2013, and is also a continuation-in-part of U.S. application Ser. No. 13/946,500, filed Jul. 17, 2013, which is a divisional of U.S. application Ser. No. 13/756,910, filed Feb. 1, 2013, now U.S. Pat. No. 8,523,486, which in turn claims the benefit of U.S. Provisional Application Ser. Nos. 61/595,404, filed Feb. 6, 2012, 61/598,672, filed Feb. 14, 2012, and 61/714,323 filed Oct. 16, 2012, all of which are incorporated herein by reference.

TECHNICAL FIELD

The present application relates to the general art of structural, bridge and geotechnical engineering, and to the particular field of concrete bridge and culvert structures.

BACKGROUND

Overfilled bridge structures are frequently formed of precast or cast-in-place reinforced concrete and are used in the case of bridges to support a first pathway over a second pathway, which can be a waterway, a traffic route, or in the case of other structures, a buried storage space or the like (e.g., for stormwater detention). The term "overfilled bridge" will be understood from the teaching of the present disclosure, and in general as used herein, an overfilled bridge is a bridge formed of bridge elements or units that rest on a foundation with soil or the like resting thereon and thereabout to support and stabilize the structure and in the case of a bridge to provide the surface of (or support surface for) the first pathway.

In any system used for bridges, particularly stream crossings, engineers are in pursuit of a superior blend of hydraulic opening and material efficiency. In the past, precast concrete bridge units of various configurations have been used, including four side units, three-sided units and true arches (e.g., continuously curving units). Historical systems of rectangular or box-type four-sided and three-sided units have proven inefficient in their structural shape requiring large side wall and top-slab thicknesses to achieve desired spans. Historical arch shapes have proven to be very efficient in carrying structural loads but are limited by their reduced hydraulic opening area. An improvement, as shown and described in U.S. Pat. No. 4,993,872, was introduced that combined vertical side walls and an arched top that provided a benefit with regard to this balance of hydraulic open area to structural efficiency. One of the largest drivers to structural efficiency of any culvert/bridge shape is the angle of the corners. The closer to 90 degrees at the corner, the higher the bending moment and therefore the thicker the cross-section of the haunch needs to be. Thus, the current vertical side and arch top shape is still limited by the corner angle, which while improved is still at one-hundred fifteen degrees.

A variation of the historic flat-top shape has also been introduced, as shown in U.S. Pat. No. 7,770,250, that combines a flat, horizontal top with an outwardly flared leg of uniform thickness. The resulting shape provides some improvements to hydraulic efficiency versus the flat-top by adding open area and also provides some improvement structurally by flattening the angle between the top and legs to about one-hundred ten degrees. However, flat-tops are severely limited in the ability to reach longer spans needed for many applications (e.g., the effective limit for flat top spans is in the range of thirty to forty feet).

An improved bridge system would therefore be advantageous to the industry.

SUMMARY

In one aspect, a concrete culvert assembly for installation in the ground, includes a set of spaced apart elongated footers and a plurality of precast concrete culvert sections supported by the footers in side by side alignment. Each of the concrete culvert sections has an open bottom, a top wall and spaced apart side walls to define a passage thereunder. Each of the side walls extends downward and outward from the top wall and has a substantially planar inner surface and a substantially planar outer surface. The top wall has an arch-shaped inner surface and an arch-shaped outer surface and a substantially uniform thickness. First and second haunch sections each join one of the side walls to top wall, each haunch section defining a corner thickness greater than the thickness of the top wall. For each side wall bot an interior angle and an exterior angle is defined. The interior side wall angle is defined by intersection of a first plane in which the inner surface of the side wall lies and a second plane that is perpendicular to a radius that defines at least part of the arch-shaped inner surface of the top wall at a first point along the arch-shaped inner surface of the top wall. The exterior side wall angle defined by intersection of a third plane in which the outer surface of the side wall lies and a fourth plane that is perpendicular to a radius that defines at least part of the arch-shaped outer surface of the top wall at a second point along the arch-shaped outer surface. The third plane is non-parallel to the first plane. The interior side wall angle is at least one-hundred and thirty degrees and the exterior side wall angle is at least one-hundred and thirty-five degrees, with the exterior side wall angle being different than the interior side wall angle. Each side wall is tapered from top to bottom such that a thickness of each side wall decreases when moving from the top of each side wall to the bottom of each side wall.

In one implementation of the foregoing aspect, for each side wall of each concrete culvert section, an angle of intersection between the first plane and the third plane is at least 1 degree.

In one implementation of the concrete culvert assembly of the two preceding paragraphs, for each culvert section, a ratio of haunch thickness to top wall thickness is no more than about 2.30.

In one implementation of the concrete culvert assembly of any of the three preceding paragraphs, for each concrete culvert section, the inner surface of each side wall intersects with an inner surface of its adjacent haunch section at an interior haunch intersect line, a vertical distance between the defined interior haunch intersect line and top dead center of the arch-shaped inner surface of the top wall being between no more than eighteen percent (18%) of a radius of curvature of the arch-shaped inner surface of the top wall at top dead center.

In one implementation of the concrete culvert assembly of any of the four preceding paragraphs, for each concrete culvert section, the inner surface of each side wall intersects with an inner surface of its adjacent haunch section at an interior haunch intersect line, the haunch section includes an exterior corner that is spaced laterally outward of the interior haunch intersect line, and a horizontal distance between each interior haunch intersect line and the corresponding exterior corner is no more than about 91% of the horizontal width of the bottom surface of the side wall.

In one implementation of the concrete culvert assembly of any of the five preceding paragraphs, for each concrete culvert assembly, a distance between the inner surface at the bottom of one side wall and the inner surface at the bottom of the other side wall defines a bottom span of the unit, the bottom span is greater than a radius of curvature of the arch-shaped inner surface of the top wall at top dead center.

In one implementation of the concrete culvert assembly of any of the six preceding paragraphs, for each concrete culvert section, the thickness at the bottom of each side wall is no more than 90% of the thickness of the top wall at top dead center of the top wall.

In one implementation of the concrete culvert assembly of any of the seven preceding paragraphs, for each concrete culvert section, a bottom portion of each side wall of each culvert section includes a vertical flat segment on the outer surface.

In one implementation of the concrete culvert assembly of any of the eight preceding paragraphs, each end unit of the plurality of concrete culvert sections includes a corresponding headwall assembly positioned on the top wall and the side walls.

In one implementation of the concrete culvert assembly of any of the nine preceding paragraphs, each headwall assembly includes a top headwall portion and side headwall portions that are formed unitary with each other and connected to the top wall and side walls by at least one counterfort structure on the top wall and at least one counterfort structure on each side wall. In another implementation of the concrete culvert assembly of any of the nine preceding paragraphs, each headwall assembly includes a top headwall portion and side headwall portions that are formed by at least two distinct pieces, the headwall assembly connected to the top wall and side walls by at least one counterfort structure on the top wall and at least one counterfort structure on each side wall.

In one implementation of the concrete culvert assembly of any of the ten preceding paragraphs, each haunch section includes an inner surface defined by a haunch radius, for each side wall the first point is the location where the radius that defines the arch-shaped inner surface of the top wall meets the haunch radius associated with the side wall.

In one implementation of the concrete culvert assembly of any of the eleven preceding paragraphs, each concrete culvert section is formed in two halves, each half formed by one side wall and a portion of the top wall, the two top portions secured together along a joint at a central portion of the top wall of the culvert section.

In one implementation of the concrete culvert assembly of any of the twelve preceding paragraphs, for each side wall the first point is a location at which the arch-shaped inner surface meets an inner surface of the haunch section adjacent the side wall, and the second point is either a location where the arch-shaped outer surface intersects the third plane or a location where the arch-shaped outer surface meets a planar end outer surface portion of the top wall at the haunch section.

In another aspect, a method is provided for manufacturing a concrete culvert section having an open bottom, a top wall and spaced apart side walls to define a passage thereunder, each of the side walls having a substantially planar inner surface and a substantially planar outer surface, the top wall having an arch-shaped inner surface and an arch-shaped outer surface and a substantially uniform thickness, each side wall having varying thickness that decreases when moving from the top of each side wall to the bottom of each side wall, first and second haunch sections, each haunch section joining one of the side walls to the top wall, and each haunch section defining a corner thickness greater than the thickness of the top wall. The method involves: providing a form system in which, for each side wall, an interior form structure portion defines the position of the inner surface of the side wall and an exterior form structure portion defines the position and orientation of the outer surface of the side wall, the exterior form structure portion arranged to pivot or to move along a surface of top wall form structure portion; based upon an established bottom span or rise for the culvert section, pivoting the exterior form structure portion or moving the exterior form structure portion to a position that sets a relative angle between interior form structure portion and the exterior form structure portion; and filling the form structure with concrete to produce the culvert section.

In one implementation of the method of the preceding paragraph, the form structure lays on one face and the exterior form structure portion for each side wall includes a bottom side arranged to slide over a corresponding side wall form seat structure.

In one implementation of the method of any of the two preceding paragraphs, a bottom form structure is positioned between the interior form structure and the exterior form structure to define the intended width for the bottom surface of the resulting side wall.

In another aspect, a concrete culvert assembly for installation in the ground includes a set of spaced apart elongated footers, and a plurality of precast concrete culvert sections supported by the footers in side by side alignment. Each of concrete culvert sections has an open bottom, a top wall and spaced apart side walls to define a passage thereunder. Each of the side walls extends downward and outward from the top wall and has a substantially planar inner surface and a substantially planar outer surface. The top wall has an arch-shaped inner surface and an arch-shaped outer surface, first and second haunch sections, each haunch section joining one of the side walls to the top wall, each haunch section defining a corner thickness greater than the thickness of the top wall. Each side wall is tapered from top to bottom such that a thickness of each side wall decreases when moving from the top of each side wall to the bottom of each side wall. A ratio of haunch thickness to top wall thickness at top dead center is no more than about 2.30. The inner surface of each side wall intersects with an inner surface of its adjacent haunch section at an interior haunch intersect line, and each haunch section includes an exterior corner that is spaced laterally outward of the interior haunch intersect line. A horizontal distance between each interior haunch intersect line and the corresponding exterior corner is no more than about 91% of a horizontal width of the bottom surface of the side wall, the thickness at the bottom of each side wall is no more than 90% of the thickness of the top wall at top dead center of the top wall, and a ratio of a first vertical distance over a second vertical distance is at least about 55%, where the first vertical distance is the vertical distance between the height of the exterior corner of the haunch and the height of top dead center of the arch-shaped outer surface of the top wall, and the second vertical distance is the vertical distance between the height of a defined interior haunch intersect line and the height of top dead center of the arch-shaped inner surface of the top wall.

In one implementation of the concrete culvert assembly of the preceding paragraph, each concrete culvert section is formed in two halves, each half formed by one side wall and a portion of the top wall, the two top portions secured together along a joint at a central portion of the top wall of the culvert section.

In another aspect, a concrete culvert section includes an open bottom, a top wall and spaced apart side walls to define a passage thereunder, each of the side walls extending downward and outward from the top wall. Each of the side walls has a substantially planar inner surface and a substantially planar outer surface, and the top wall has an arch-shaped inner surface and an arch-shaped outer surface and a substantially uniform thickness. First and second haunch sections each join one of the side walls to the top wall, each haunch section defining a corner thickness greater than the thickness of the top wall. For each side wall an interior side wall angle is defined by intersection of a first plane in which the inner surface of the side wall lies and a second plane that is perpendicular to a radius that defines at least part of the arch-shaped inner surface of the top wall at a first point along the arch-shaped inner surface of the top wall. An exterior side wall angle is defined by intersection of a third plane in which the outer surface of the side wall lies and a fourth plane that is perpendicular to a radius that defines at least part of the arch-shaped outer surface of the top wall at a point along the arch-shaped outer surface, the third plane being non-parallel to the first plane. The interior side wall angle is at least one-hundred and thirty degrees, the exterior side wall angle is at least one-hundred and thirty-five degrees, the exterior side wall angle is different than the interior side wall angle. Each side wall is tapered from top to bottom such that a thickness of each side wall decreases when moving from the top of each side wall to the bottom of each side wall.

In one implementation of the culvert section of the preceding paragraph, a ratio of a first vertical distance over a second vertical distance is at least about 55%, where the first vertical distance is the vertical distance between the height of exterior corner of the haunch and the height of top dead center of the arch-shaped outer surface of the top wall, and the second vertical distance is the vertical distance between the height of a defined interior haunch intersect line and the height of top dead center of the arch-shaped inner surface of the top wall.

In one implementation of the culvert section of either of the two preceding paragraphs, each haunch section includes an inner surface defined by a haunch radius, the first point is the location where the radius that defines the arch-shaped inner surface of the top wall meets the haunch radius.

In one implementation of the culvert section of any of the three preceding paragraphs, the concrete culvert section is formed by two halves, each half formed by one side wall and a portion of the top wall, the two top portions secured together along a joint at a central portion of the top wall of the culvert section.

In one implementation of the culvert section of any of the four preceding paragraphs, each side wall has an exterior vertical flat extending upward from a horizontal bottom surface thereof.

In another aspect, a concrete culvert assembly for installation in the ground includes a set of spaced apart elongated footers, a plurality of precast concrete culvert sections supported by the footers in side by side alignment. Each of the concrete culvert sections has an open bottom, an arch-shaped top wall and spaced apart side walls to define a passage thereunder, each of the side walls extending downward and outward from the top wall. Each of the side walls has a substantially planar inner surface and a substantially planar outer surface. First and second haunch sections each join one of the side walls to the top wall, each haunch section defining a corner thickness greater than a thickness of the top wall. Each side wall is tapered from top to bottom such that a thickness of each side wall decreases when moving from the top of each side wall to the bottom of each side wall. A bottom portion of each side wall has an exterior vertical flat extending upward from a horizontal bottom surface thereof, wherein the exterior vertical flat is between about 3 inches and 7 inches high.

In one implementation of the culvert assembly of the preceding paragraph, each concrete culvert section is formed in two halves, each half formed by one side wall and a portion of the top wall, the two top portions secured together along a joint at a central portion of the top wall of the culvert section.

In one implementation of the culvert assembly of either of the two preceding paragraphs, each culvert section is seated atop a foundation system and the exterior vertical flat of each culvert section abuts lateral supporting structure of the foundation system.

In one implementation of the culvert assembly of any of the three preceding paragraphs, the foundation system includes precast concrete units and cast-in-place concrete, the lateral supporting structure is cast-in-place concrete.

In another aspect, a multi-channel culvert assembly includes a first culvert unit having an arch-shaped top wall, a first side wall extending substantially vertically downward from the top wall and a second sidewall extending downward and outward from the top wall, and a second culvert unit having an arch-shaped top wall, a first side wall extending substantially vertically downward from the top wall and a second sidewall extending downward and outward from the top wall. The first culvert unit is positioned with its first side wall toward an inner part of the assembly and the second culvert unit is positioned with its first side wall toward an inner side of the assembly to create first and second channels of the assembly, the first channel beneath the first culvert unit, the second channel beneath the second culvert unit, wherein the first channel has an inner side that is substantially vertical and an outer side that is angled from vertical and the second channel has an inner side that is substantially vertical and an outer side that is angled from vertical.

In one implementation of the culvert assembly, a surface of the first side wall of the first culvert unit is positioned adjacent a surface of the first side wall of the second culvert unit. The first culvert unit and the second culvert unit may also be identical in shape and size.

In one implementation of the culvert assembly, at least one intermediate culvert unit is positioned between the first culvert unit and the second culvert unit, where the intermediate culvert unit includes an arch-shaped top, a first side wall extending substantially vertically downward from the top wall and a second side wall extending substantially vertically downward from the top wall. The intermediate culvert unit forms an intermediate channel located between the first channel and the second channel, both sides of the intermediate channel being substantially vertical.

In one implementation of the assembly including an intermediate culvert unit, the first side wall of the first culvert unit is located adjacent to and in contact with the first side wall of the intermediate culvert unit, and the first side wall of the second culvert unit is located adjacent to and in contact with the second side wall of the intermediate culvert unit.

In another implementation of the assembly including an intermediate culvert unit, multiple intermediate culvert units are positioned between the first culvert unit and the second culvert unit, the first culvert unit and the second culvert unit are identical in shape and size but have opposite orientations, the multiple intermediate culvert units each have the same shape and size.

In another implementation of the assembly including an intermediate culvert unit, multiple intermediate culvert units are positioned between the first culvert unit and the second culvert unit. The first side wall of the first culvert unit is located adjacent to and in contact with one side wall of a first of the intermediate culvert units, and the first side wall of the second culvert unit is located adjacent to and in contact with one side wall of a second of the intermediate culvert units.

In another aspect, a multi-channel culvert assembly includes a first culvert unit having an arch-shaped top wall, a first side wall extending substantially vertically downward from the top wall and having substantially parallel inner and outer surfaces, and a second sidewall extending downward and outward from the top wall and having non-parallel inner and outer surfaces whereby the second sidewall is tapered from top to bottom such that a thickness of the second side wall decreases when moving from top to bottom. A second culvert unit has an arch-shaped top wall, a first side wall extending substantially vertically downward from the top wall and having substantially parallel inner and outer surfaces, and a second sidewall extending downward and outward from the top wall and having non-parallel inner and outer surfaces whereby the second sidewall is tapered from top to bottom such that a thickness of the second side wall decreases when moving from top to bottom. The first culvert unit is positioned with its first side wall toward an inner part of the assembly and the second culvert unit is positioned with its first side wall toward an inner side of the assembly to create first and second channels of the assembly, the first channel beneath the first culvert unit, the second channel beneath the second culvert unit, wherein the first channel has an inner side that is substantially vertical and an outer side that is angled from vertical and the second channel has an inner side that is substantially vertical and an outer side that is angled from vertical.

In one implementation of the preceding culvert assembly, a surface of the first side wall of the first culvert unit is positioned adjacent a surface of the first side wall of the second culvert unit.

In another implementation of the preceding culvert assembly, at least one intermediate culvert unit is positioned between the first culvert unit and the second culvert unit, the intermediate culvert unit including an arch-shaped top, a first side wall extending substantially vertically downward from the top wall and a second side wall extending substantially vertically downward from the top wall, the intermediate culvert unit forming an intermediate channel located between the first channel and the second channel, both sides of the intermediate channel being substantially vertical.

In one implementation of the culvert assembly including an intermediate culvert unit, the first side wall of the first culvert unit is located adjacent to and in contact with the first side wall of the intermediate culvert unit, and the first side wall of the second culvert unit is located adjacent to and in contact with the second side wall of the intermediate culvert unit.

In another implementation of the culvert assembly including an intermediate culvert unit, multiple intermediate culvert units are positioned between the first culvert unit and the second culvert unit, wherein the first side wall of the first culvert unit is located adjacent to and in contact with one side wall of a first of the intermediate culvert units, and the first side wall of the second culvert unit is located adjacent to and in contact with one side wall of a second of the intermediate culvert units.

In another aspect, a concrete culvert assembly for installation in the ground includes a plurality of precast concrete twin leaf culvert sections, each of the twin leaf concrete culvert sections formed by a pair of opposed leaf section halves secured together along a central top joint. Each of the twin leaf section concrete culver sections includes: an open bottom, a top wall and spaced apart side walls to define a passage thereunder, each of said side walls extending downward and outward from the top wall, each of said side walls having a substantially planar inner surface and a substantially planar outer surface, the top wall having an arch-shaped inner surface with curved side sections and an interior joint section with a generally planar inner surface, first and second haunch sections, each haunch section joining one of the side walls to the top wall, each haunch section defining a corner thickness greater than the thickness of the top wall, for each side wall an interior side wall angle is defined by intersection of a first plane in which the inner surface of the side wall lies and a second plane that is perpendicular to a radius that defines at least part of the arch-shaped inner surface of the top wall at a first point along the arch-shaped inner surface of the top wall, an exterior side wall angle is defined by intersection of a third plane in which the outer surface of the side wall lies and a fourth plane that is perpendicular to a radius that defines at least part of the arch-shaped outer surface of the top wall at a second point along the arch-shaped outer surface, the third plane being non-parallel to the first plane, the exterior side wall angle being different than the interior side wall angle, and each side wall being tapered from top to bottom such that a thickness of each side wall decreases when moving from the top of each side wall to the bottom of each side wall.

In one implementation, each side wall of each twin leaf concrete culvert section, an angle of intersection between the first plane and the third plane is at least 1 degree.

In one implementation, for each twin leaf concrete culvert section, a ratio of haunch thickness to top wall thickness is no more than about 2.30.

In one implementation, for each twin leaf concrete culvert section, the inner surface of each side wall intersects with an inner surface of its adjacent haunch section at an interior haunch intersect line, the haunch section includes an exterior corner that is spaced laterally outward of the interior haunch intersect line, and a horizontal distance between each interior haunch intersect line and the corresponding exterior corner is no more than about 91% of the horizontal width of the bottom surface of the side wall.

In one implementation, for each twin leaf concrete culvert assembly, a distance between the inner surface at the bottom of one side wall and the inner surface at the bottom of the other side wall defines a bottom span of the unit, the bottom span is greater than a radius of curvature of the arch-shaped inner surface of the top wall at top dead center.

In one implementation, for each twin leaf concrete culvert section, the thickness at the bottom of each side wall is no more than 90% of the thickness of the top wall at top dead center of the top wall.

In one implementation, for each twin leaf concrete culvert section, a bottom portion of each side wall of each culvert section includes a vertical flat segment on the outer surface.

In certain implementations of the culvert assembly, each twin leaf culver section may include the combination of 2 or more of the features of any of the six preceding paragraphs.

DETAILED DESCRIPTION

Figure 3:
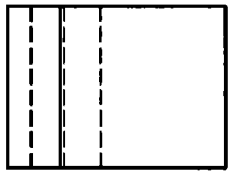
FIG. 3 is an end elevation of the culvert section of FIG. 1.
Figure 1:
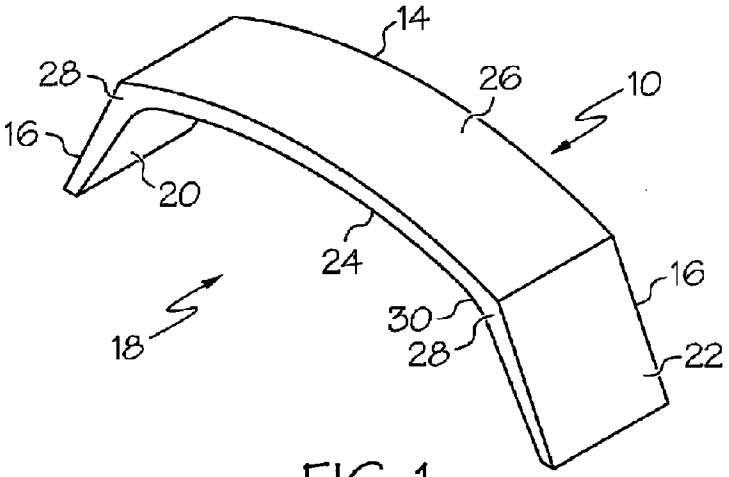
FIG. 1 is a perspective view of one embodiment of a culvert section.
Figure 2:
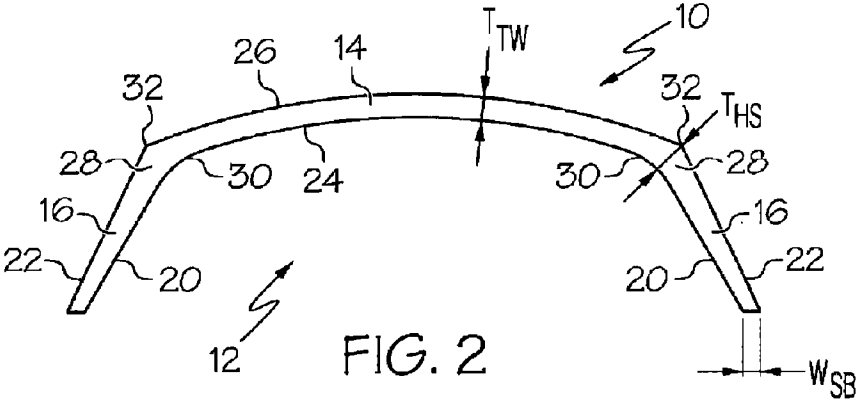
FIG. 2 is a side elevation of the culvert section of FIG. 1.

Referring to FIGS. 1-3, perspective, side elevation and end elevation views of an advantageous precast concrete culvert unit/section 10 are shown. The culvert unit 10 includes an open bottom 12, a top wall 14 and spaced apart side walls 16 to define a passage 18 thereunder. Each of the side walls has a substantially planar inner surface 20 and a substantially planar outer surface 22. The top wall has an arch-shaped inner surface 24 and an arch-shaped outer surface 26 and a substantially uniform thickness $T_{TW}$. In various implementations, the arch-shaped inner surface and arch-shaped outer surface can each be made up of or defined by (i) a respective single radius, (ii) a respective set of joined radiuses (e.g., the surface is curved along its entire length) or (iii) in some cases planar sections may be included either the most center region of each arch-shaped surface or at the end portion of each arch-shaped surface. As used herein the term "arch-shaped" when referring to such surfaces encompasses all such variations. Haunch sections 28 join each side wall 16 to the top wall 14.

Each haunch section has a corner thickness $T_{HS}$ greater than the thickness $T_{TW}$ of the top wall. In this regard, the corner thickness $T_{HS}$ is measured perpendicular to the curved inner surface 30 of the haunch section along a line that passes through the exterior corner 32 of the haunch section. While the larger corner thickness of a unit as compared to the side wall and top wall thickness of the same unit is critical to the structural performance of the unit, the present culvert unit is configured to more effectively distribute load from the top wall to the side walls of the present culvert unit so that the corner thickness of the present culvert unit can be reduced in comparison to prior art culvert units.

Figure 4:
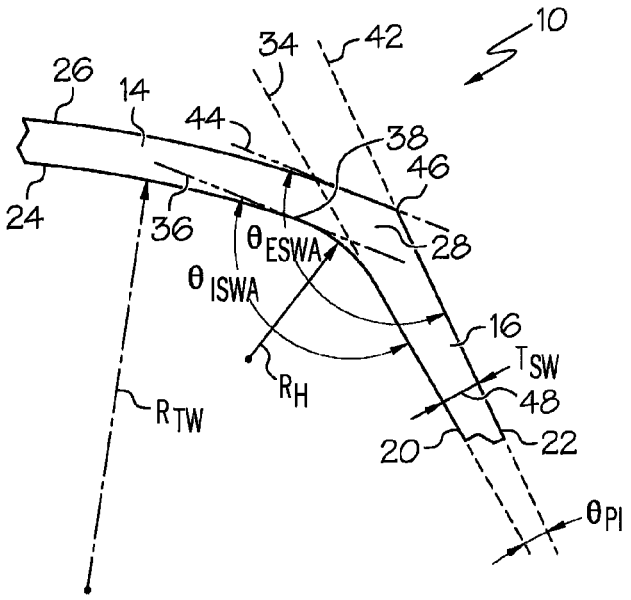
FIG. 4 is a partial side elevation showing the haunch of the culvert section of FIG. 1.

In this regard, and with reference to the partial view of FIG. 4, an interior side wall angle $\theta_{ISWA}$ between the side wall 16 and the top wall 14 is defined by intersection of a plane 34 in which the inner surface of the side wall lies and a line or plane 36 that is tangent to the inner surface 24 of the top wall at the point or line 38 where the top wall inner surface 24 meets the haunch inner surface 30 (e.g., where the inner surface of the unit transitions from the radius $R_{TW}$ to the radius $R_H$ defining the inner surface haunch). Thus, the plane 36 is perpendicular to the radius $R_{TW}$ that defines the arch-shaped inner surface of the top wall at a point 38 where the radius $R_{TW}$ stops and the radius $R_H$ starts. In some implementations $R_{TW}$ will define the entire span of inner surface 24 from haunch to haunch. In other implementations the center portion of the top wall inner surface 24 may be defined by one radius and the side portions of the inner surface 24 may be defined by a smaller radius $R_{TW}$. The illustrated unit 10 is constructed such that the interior side wall angle $\theta_{ISWA}$ is at least one-hundred and thirty degrees, and more preferably at least one-hundred thirty-three degrees. This relative angle between the top wall and side wall reduces bending moment in the haunch section as compared to prior art units, enabling the thickness of the haunch sections 28 to be reduced and the amount of steel used in the haunch sections to be reduced, resulting in a reduction in material needed, along with a corresponding reduction in unit weight and material cost per unit. Moreover, the center of gravity of the overall unit is moved downward by reducing concrete in the haunch sections, thereby placing the center of gravity closer to the midway point along the overall height or rise of the unit. As units will be generally shipped laying down as opposed to upright, and it is desirable to place the center of gravity in alignment with the center line of the vehicle bed used to ship the units, this lowering of the center of gravity can facilitate proper placement of units with an overall greater height on the vehicle bed without requiring as much overhang as prior art units.

Figure 4A:
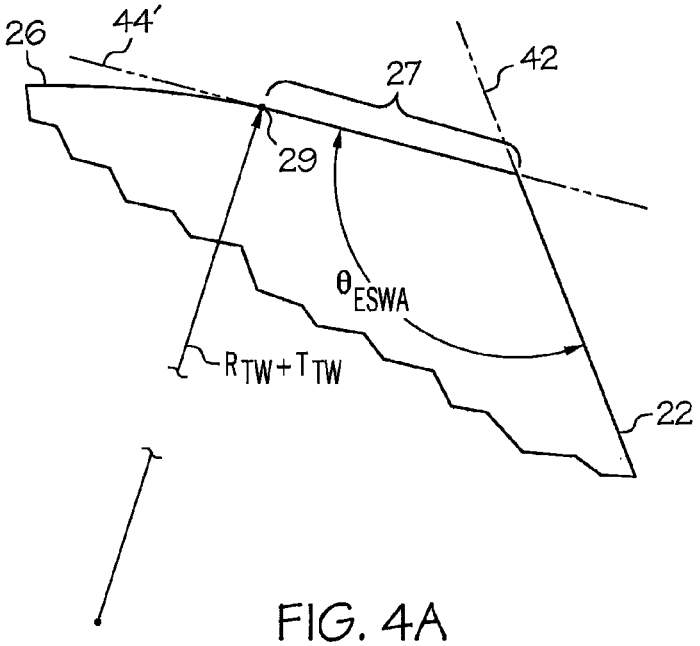
FIG. 4A is a partial side elevation showing an alternative configuration of the outer surface in the region of the top wall and haunch.

This reduction in concrete usage can further be enhanced by appropriate configuration of the side walls 16 of the unit. Specifically, an exterior side wall angle $\theta_{ESWA}$ between the top wall 14 and the side wall 16 is defined by intersection of a plane 42 in which the outer surface 22 of the side wall lies and a line or plane 44 that is tangent to the top wall outer surface 26 at the point or line 46 where the outer surface 26 intersects the plane 42. It is noted that for the purpose of evaluating the exterior side wall angle the outer surface of the top wall is considered to extend along the full span at the top of the unit (e.g., from corner 32 to corner 32). The radius that defines the outer surface 26 of the top wall near the corners 32 may typically be $R_{TW}+T_{TW}$, but in some cases the radius of the outer surface 26 in the corner or end region may vary. In other cases, particularly for larger spans, as shown in FIG. 4A, the corner or end regions of outer surface 26 may include planar end portions 27, in which case the plane 44' would in fact be perpendicular to the radius (e.g., $R_{TW}+T_{TW}$) that defines the outer surface 26 at the point or line 29 where that radius (e.g., $R_{TW}+T_{TW}$) meets the planar end portion 27 of the surface 26.

As shown, the exterior side wall plane 42 is non-parallel to the interior side wall plane 34, such that each side wall 16 is tapered from top to bottom, with thickness along the height of the side wall decreasing when moving from the top of each side wall down toward the bottom of each side wall. In this regard, the thickness of the side wall $T_{SW}$ at any point along it height is taken along a line that runs perpendicular to the interior side wall plane 34 (e.g., such as line 48 in FIG. 4). By utilizing side walls with tapered thickness, the thickness of the bottom portion of the side wall (e.g., where loads are smaller) can be reduced. Preferably, the thickness at the bottom of each side wall may be no more than about 90% of the thickness of the top wall, resulting in further concrete savings as compared to units in which all walls are of uniform and common thickness. Generally, in the preferred configuration for concrete reduction, the exterior side wall angle is different than the interior side wall angle, and is significantly greater than angles used in the past, such that the exterior side wall angle $\theta_{ESWA}$ is at least one-hundred and thirty-five degrees and, in many cases, at least one-hundred and thirty-eight degrees. An angle of intersection $\theta_{PI}$ between the plane 34 in which the inner surface lies and the plane 42 in which the outer surface lies may be between about 1 and 20 degrees (e.g., between 1 and 4 degrees), depending upon the extent of taper, which can vary as described in further detail below. In certain implementations, the angle $\theta_{PI}$ is preferably at least about 2-4 degrees.

Overall, the configuration of the culvert section 10 allows for both hydraulic and structural efficiencies superior to previously known culverts. The hydraulic efficiency is achieved by a larger bottom span that is better capable of handling the more common low flow storm events. The structural efficiency is achieved by the larger side wall to top wall angle that enables the thickness of the haunch to be reduced, and enabling more effective longer span units (e.g., spans of 48 feet and larger). The reduced corner thickness and tapered legs reduce the overall material cost for concrete, and enables the use of smaller crane sizes (or longer pieces for the same crane size) during on-site installation due to the weight advantage.

Figure 5:
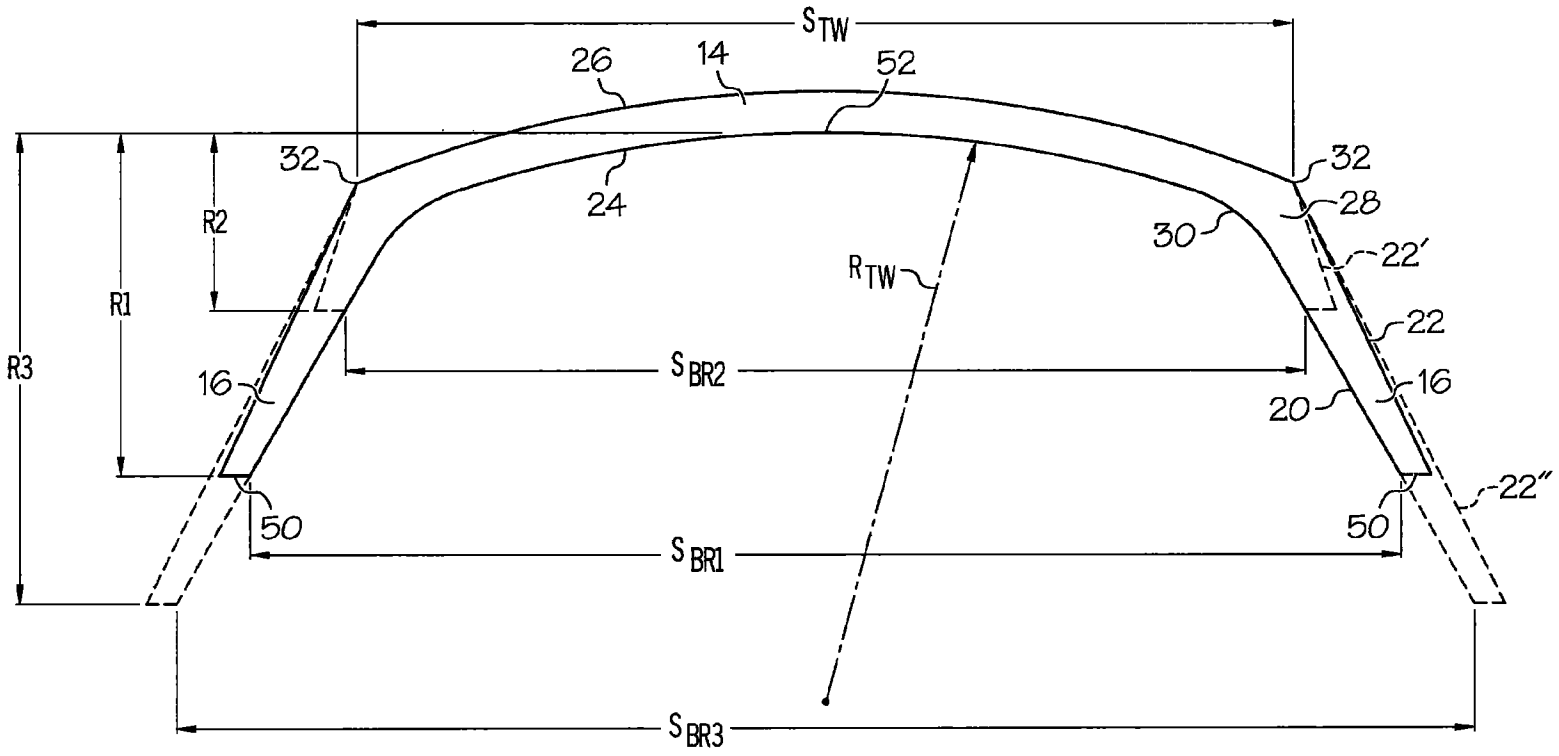
FIG. 5 is a side elevation showing configurations corresponding various rises.

The tapered side wall feature described above can be most effectively utilized by actually varying the degree of taper according to the rise to be achieved by the precast concrete unit. Specifically, and referring to the side elevation of FIG. 5, the rise of a given unit is defined by the vertical distance from the bottom edges 50 of the side walls 16 to top dead center 52 of the arch-shaped inner surface 24 of the top wall 14. Three different rises are illustrated in FIG. 5, with rise R1 being the rise for the unit shown in FIGS. 1-3, rise R2 being a smaller rise and rise R3 being a larger rise. As shown, the side wall taper varies as between the three different rises, utilizing a constant top span $S_{TW}$ defined as the horizontal distance between the haunch corners 32. Notably, in one embodiment, the side wall taper is more aggressive in the case of the smaller rise R2 as demonstrated by the exterior side wall surface 22' shown in dashed line form, and the side wall taper is less aggressive in the case of the larger rise R3 as demonstrated by the exterior side wall surface 22" shown in dashed line form. This variation in taper is achieved by varying the exterior side wall angle $\theta_{ESWA}$ (FIG. 4) according to the rise or bottom span for the unit that is to be produced. Each bottom span ($S_{BR1}$, $S_{BR2}$, $S_{BR3}$) is defined as the horizontal distance between the bottom edges of the side wall inner surfaces 20. The bottom span is preferably greater than the radius of curvature $R_{TW}$ of the arch-shaped inner surface of the top wall at top dead center in order to provide more effective waterway area for lower flow storm events (e.g., in the case of creek or stream crossings). As shown FIG. 5, the inner surface 20 of the side walls varies in length over the different rises, but the interior side wall angle does not vary.

In order to achieve the variable side wall taper feature, a form system is used in which, for each side wall, an interior form structure portion for defining the interior side wall angle is fixed and an exterior form structure portion defining the exterior side wall angle can be varied by pivoting. The pivot point for each exterior form structure portion is the exterior corner 32 of the haunch section. Based upon a desired bottom span or rise for the culvert section to be produced using the particular form, the exterior form structure portion is pivoted to a position that sets the appropriate exterior side wall angle and the exterior form structure portion is locked in position. The form structure is then filled with concrete to produce the culvert section. With respect to the pivoting operation, as shown schematically in FIG. 6, the form 60 is placed on its side for the purpose of concrete fill and casting. A form seat 62 is provided for each side wall, with the interior form structure portion 64 seating alongside the edge of the form seat 62 as is typical in precasting of bridge units. However, the exterior form structure portion 66, which pivots about a hinge axis 68, has its bottom edge raised (relative to the bottom edge of portion 64) so that portion 66 can move across the top surface of the form seat 62 during pivot. The exterior side wall angle may, in each case, be achieved by establishing a consistent horizontal width $W_{SB}$ (FIG. 2) for the bottom surface of the side wall for a given top span $S_{TW}$, regardless of the rise being produced. The form system includes a bottom form panel member 63 that is movable along the height of the form portion 64 and can be bolted in place using bolt holes 69 provided in the form structure 64. Similar bolt holes would be provided in the edge 67 of panel 63, and the edge 67 would be angled to match the surface of form portion 64 so that surface 65 of the panel will be horizontal when installed. Any unused bolt holes would be filled with plug members. Once the bottom panel 63 is at the proper location to produce the desired rise, portion 66 of the structure can be pivoted into contact with the free edge of the panel 63 and locked in position.

Figure 7:
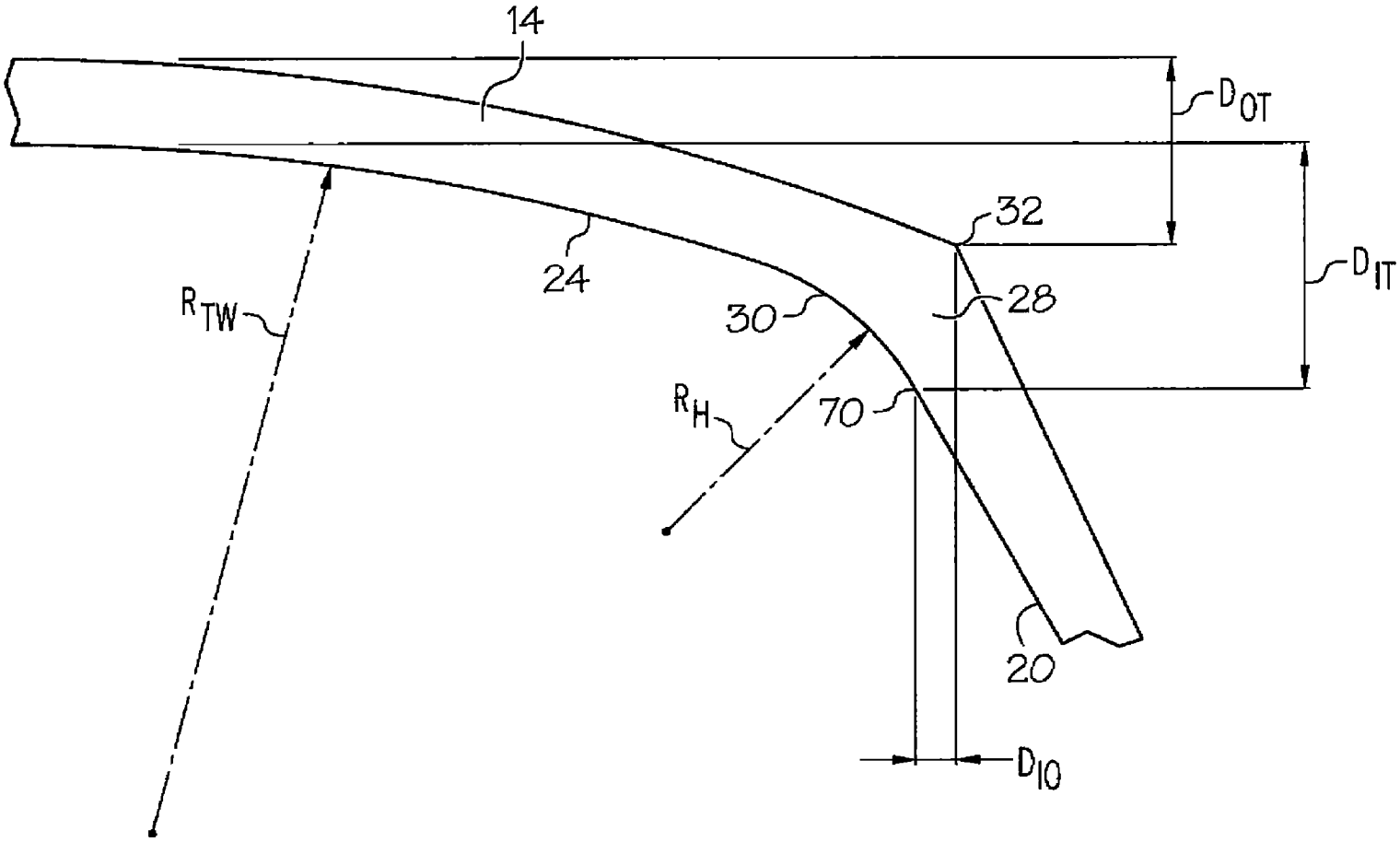
FIG. 7 is a partial side elevation showing the haunch of the culvert section of FIG. 1.

Referring now to FIG. 7, in the illustrated embodiment each haunch section 28 is defined by an inner surface 30 with a radius of curvature $R_H$, and the inner surface 20 of each side wall intersects with the inner surface of its adjacent haunch section 28 at an interior haunch intersect line or point 70, which is the point of transition from the planar surface 20 to the radiused surface 30. A vertical distance $D_{IT}$ between the height of the defined interior haunch intersect line 70 and the height of top dead center of the arch-shaped inner surface of the top wall should be no more than about eighteen percent (18%) of the radius of curvature $R_{TW}$ of the arch-shaped inner surface 24 of the top wall at top dead center in order to more effectively reduce the haunch corner thickness. Also, a ratio of the vertical distances $D_{OT}/D_{IT}$, where $D_{OT}$ is the vertical distance between the height of exterior corner 32 of the haunch and the height of top dead center of the arch-shaped outer surface of the top wall, should preferably be no less than about 55% and, more preferably, no less than about 58%. Moreover, the exterior corner 32 of the haunch section 28 is spaced laterally outward of the interior haunch intersect line 70 by a relatively small distance, and particularly a horizontal distance that is less than the horizontal width $W_{SB}$ of the side wall bottom surface. For example, in certain implementations the horizontal distance $D_{IO}$ between each interior haunch intersect line 70 and the corresponding exterior corner 32 is preferably no more than about 95% of the horizontal width $W_{SB}$ of the side wall bottom surface, and more preferably no more than about 91%.

Figure 10:
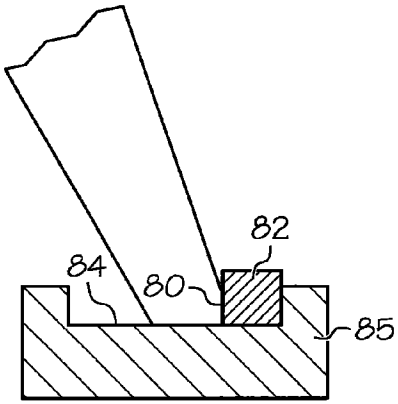
FIG. 10 is a partial side elevation of the culvert section of FIG. 8 atop a footer.
Figure 8:
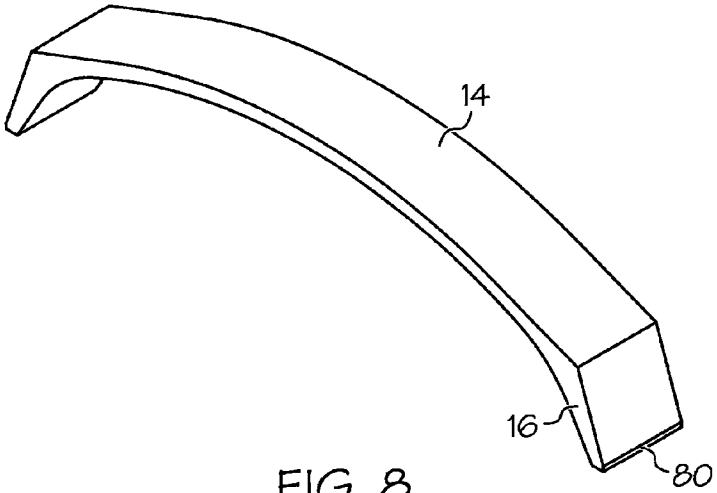
FIG. 8 is a perspective view of another embodiment of a culvert section.
Figure 9:
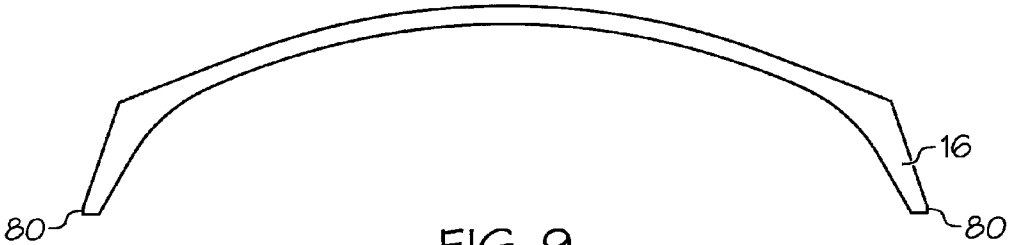
FIG. 9 is a side elevation of the culvert section of FIG. 8.
Figure 11:
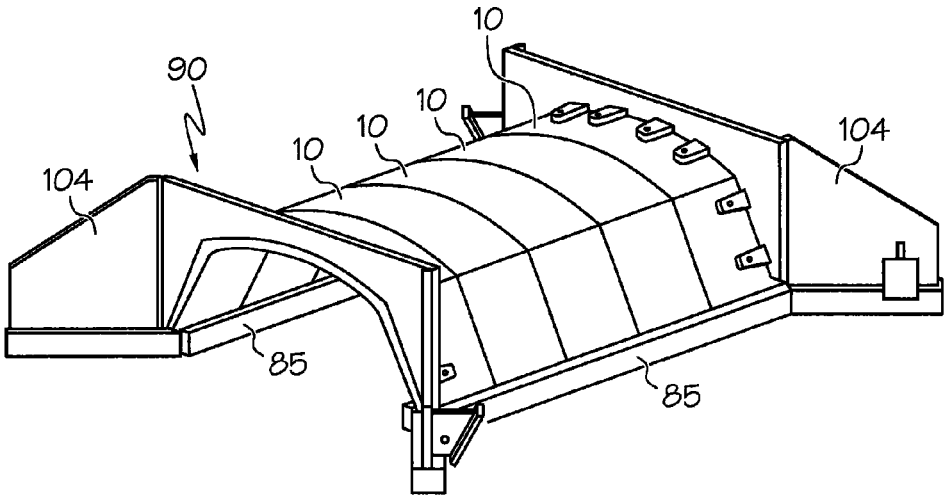
FIGS. 11-14 show one embodiment of a plurality of culvert sections according to FIG. 1 arranged side by side on spaced apart footers, with each end unit including a headwall assembly.
Figure 12:
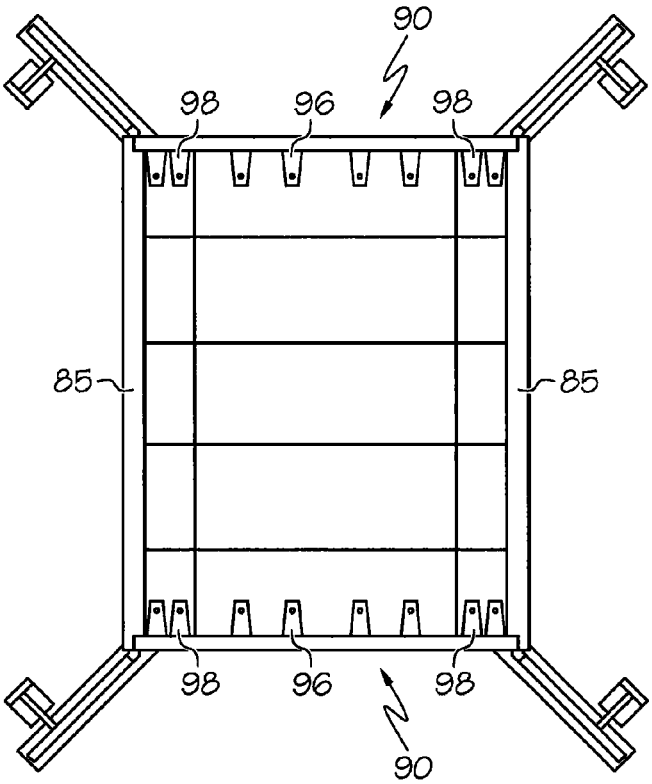
Figure 13:
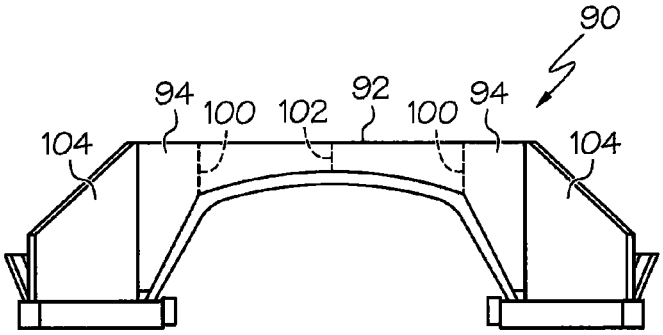
Figure 14:
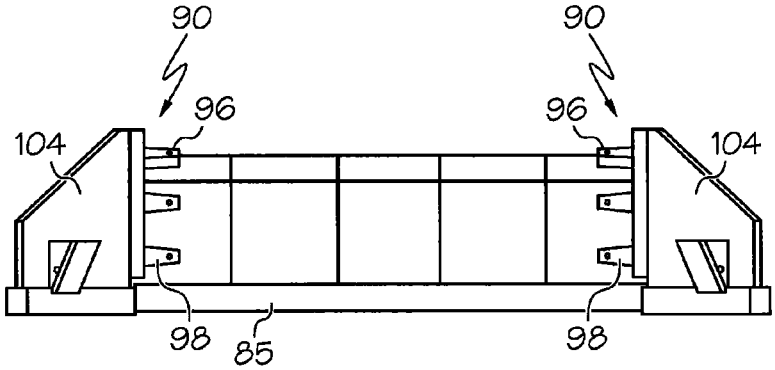

Referring now to the embodiment shown in FIGS. 8-10, in some cases it is desirable to provide a vertical flat segment 80 at the bottom portion of each side wall 16. The vertical flat 80 facilitates the use of blocking structure (e.g., wooden blocks 82 with corresponding vertical surfaces) in combination with the keyway/channel 84 in concrete footing 85 to hold the culvert sections in place, preventing the bottom ends of the side walls from moving outward under the weight of the culvert section, until the bottom ends are grouted/cemented in place.

As shown in FIGS. 11-14, each end unit of the plurality of concrete culvert sections includes a corresponding headwall assembly 90 positioned on the top wall and the side walls of the unit. As shown, in one implementation, each headwall assembly 90 includes a top headwall portion 92 and side headwall portions 94 that are formed unitary with each other and connected to the top wall and side walls by at least one counterfort structure 96 on the top wall and at least one counterfort structure 98 on each side wall. The counterfort structures may be consistent with those shown and described in U.S. Pat. No. 7,556,451 (copy attached). In another implementation, as suggested by dashed lines 100, headwall portions 94 and 96 may be formed as three distinct pieces. Alternatively, as suggested by dashed line 102 the headwall assembly may be formed in two mirrored halves. Wingwalls 104 may also be provided in abutment with the side headwall portions and extending outward therefrom as shown.

Although FIGS. 11-14 shows a fairly standard footing system for use in connection with the inventive culvert sections of the present application, alternative systems could be used. For example, the culvert sections could be used in connection with the foundation structures shown and described in U.S. Provisional Application Ser. No. 61/505,564, filed Jul. 11, 2011.

Figure 15:
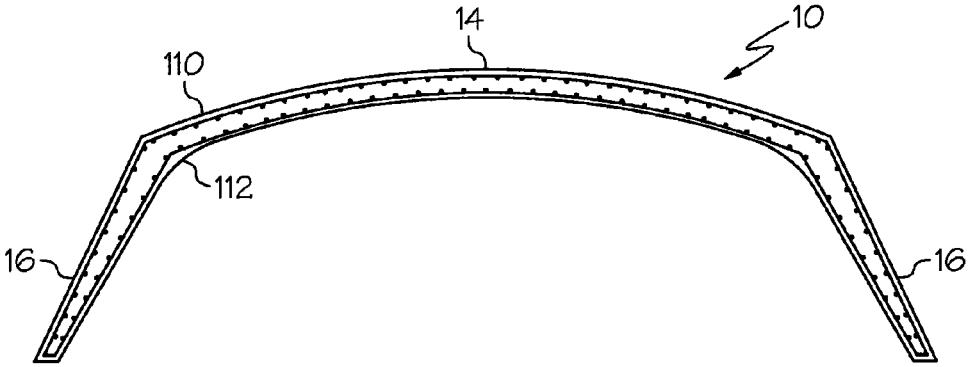
FIG. 15 shows a side elevation depicting representative reinforcement within the concrete culvert section and generally running in proximity to and along the inner and outer surfaces of the top wall and side walls.

As shown in FIG. 15, the concrete culvert section typically includes embedded reinforcement 110 and 112 generally running in proximity to and along the inner and outer surfaces of the top wall 14 and side walls 16.

Figure 6:
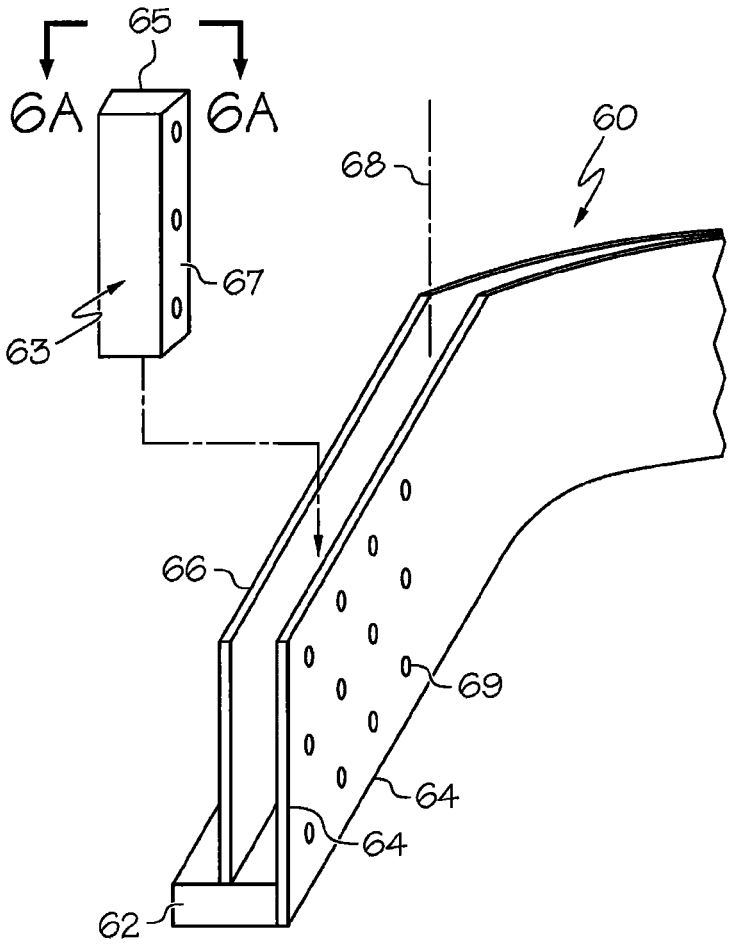
FIGS. 6 and 6A show a partial schematic view of a form system used to produce the culvert section of FIG. 1.
Figure 6A:
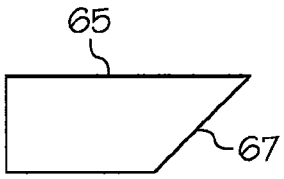
Figure 16:
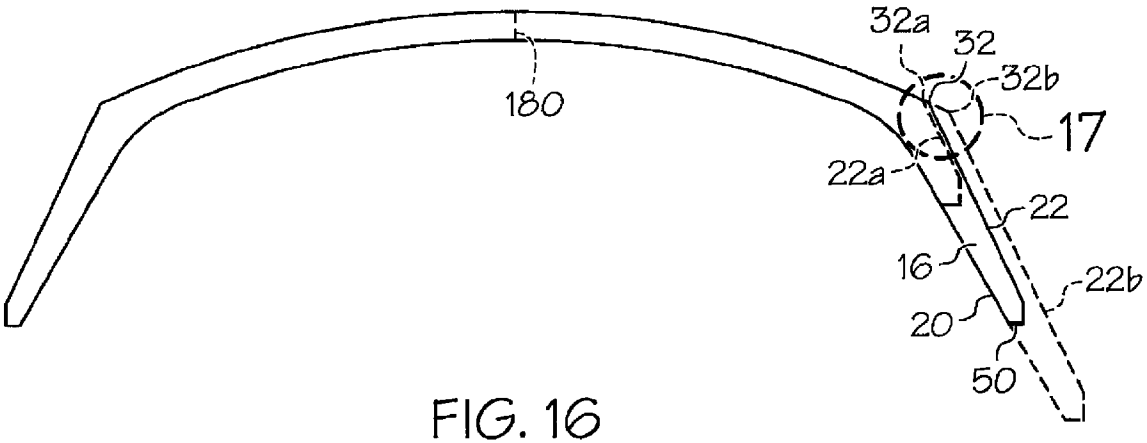
FIGS. 16-18 show an alternative embodiment of a form system for constructing the units.
Figure 17:
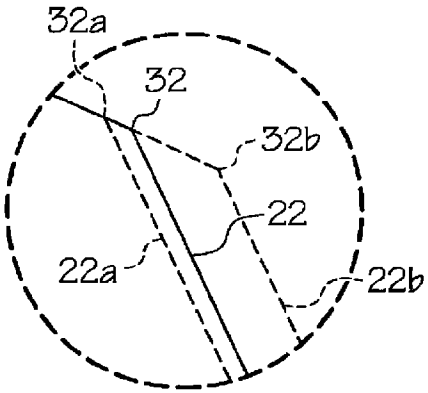

As reflected in FIGS. 5 and 6 above, in one embodiment concrete culverts of varying rises can be achieved by maintaining the outside corners of the top wall in the same position, but pivoting the outside surface of each side wall outward for larger rises, or inward for smaller rises. In an alternative embodiment per FIGS. 16-18, different rises may be achieved by shifting the outside corners of the top wall outward for larger rises and inward for smaller rises. In particular, as shown in FIGS. 16 and 17, for the rise shown in solid line form the outside corner is located at position 32 and the outer surface 22 of the side extends downward slightly toward the inner surface 20 producing a certain degree of side wall taper. When a lower rise is desired the outside corner is shifted inward to location 32*a* and when a higher rise is desired the outside corner is shifted outward to a location 32*b*. Thus, the width of the upper portion of the side wall is greater for higher rises and lower for smaller rises. The horizontal bottom part 50 of each side wall may be the same as between the different rises, and likewise the vertical part or flat 80 of the bottom of each side wall may have the same height dimension as between the different rises.

Figure 18:
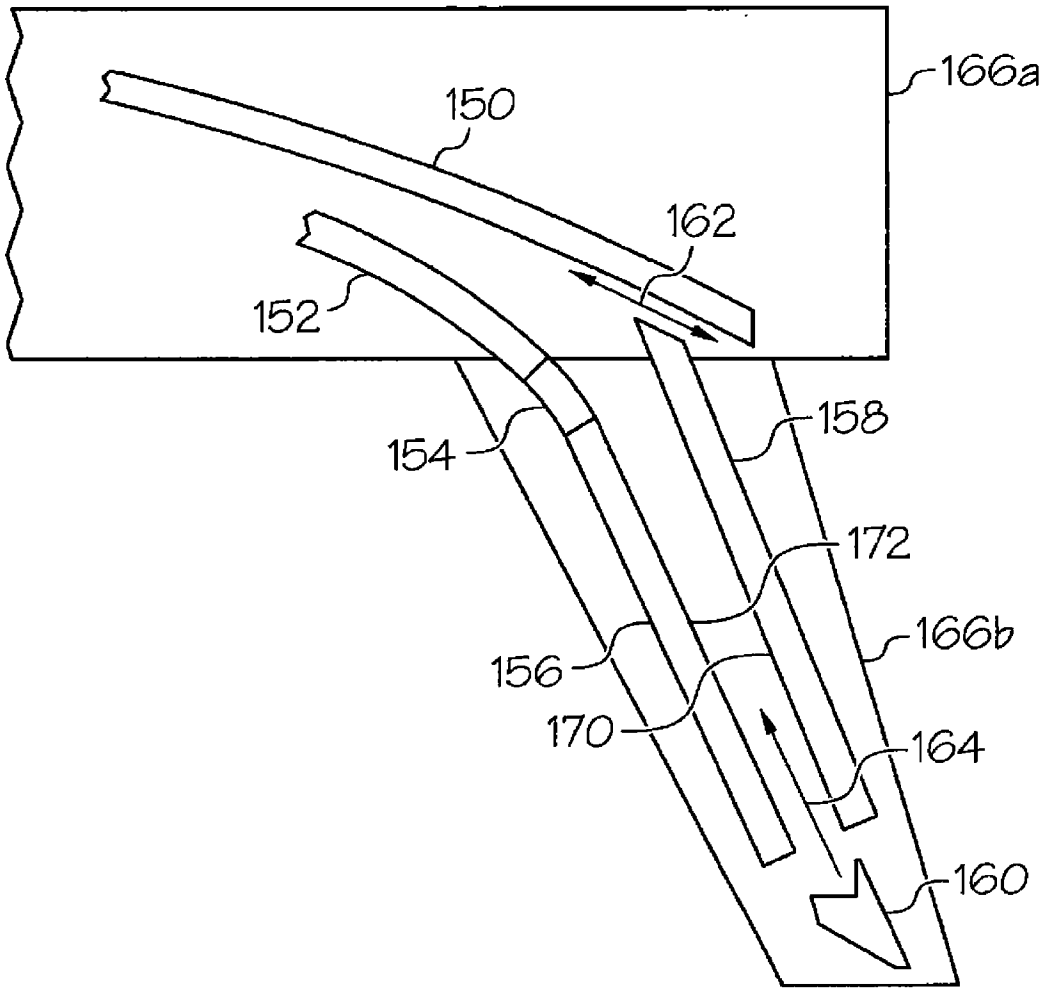

FIG. 18 reflects a form system for achieving the above embodiment, where the form system includes a top wall outer surface form unit 150, a top wall inner surface form unit 152, a haunch interior surface form unit 154, a side wall inner surface form unit 156, a side wall outer surface form unit 158 and a side wall bottom surface unit 160. To achieve different rises using this form system, the form unit 158 is moved along the surface of the form unit 150 (per arrow 162) to the needed location and bolted thereto, and the form unit 160 is moved to the appropriate location along the space between form units 156 and 158 (per arrow 164) to the appropriate location and bolted thereto. During this movement the form unit 158 slides across the top of the form seat or base structures 166*a* and 166*b* on which the form units are supported. The interior side face 170 of the form unit 158 maintains its relative angular orientation with respect to the opposed side face 172 of the form unit 156 regardless of where the form unit 158 is positioned, thus maintaining a similar degree of leg taper as between different rises. The form units 158 and 160 may additionally be bolted to the form base structure(s) 166*a* and/or 166*b* when moved to the needed locations for a given rise to assure desired positioning. A system of alignable openings in the form units 150, 158, 160 and/or the base structures 166*a* and 166*b* may be provided for such purpose.

Figure 19:
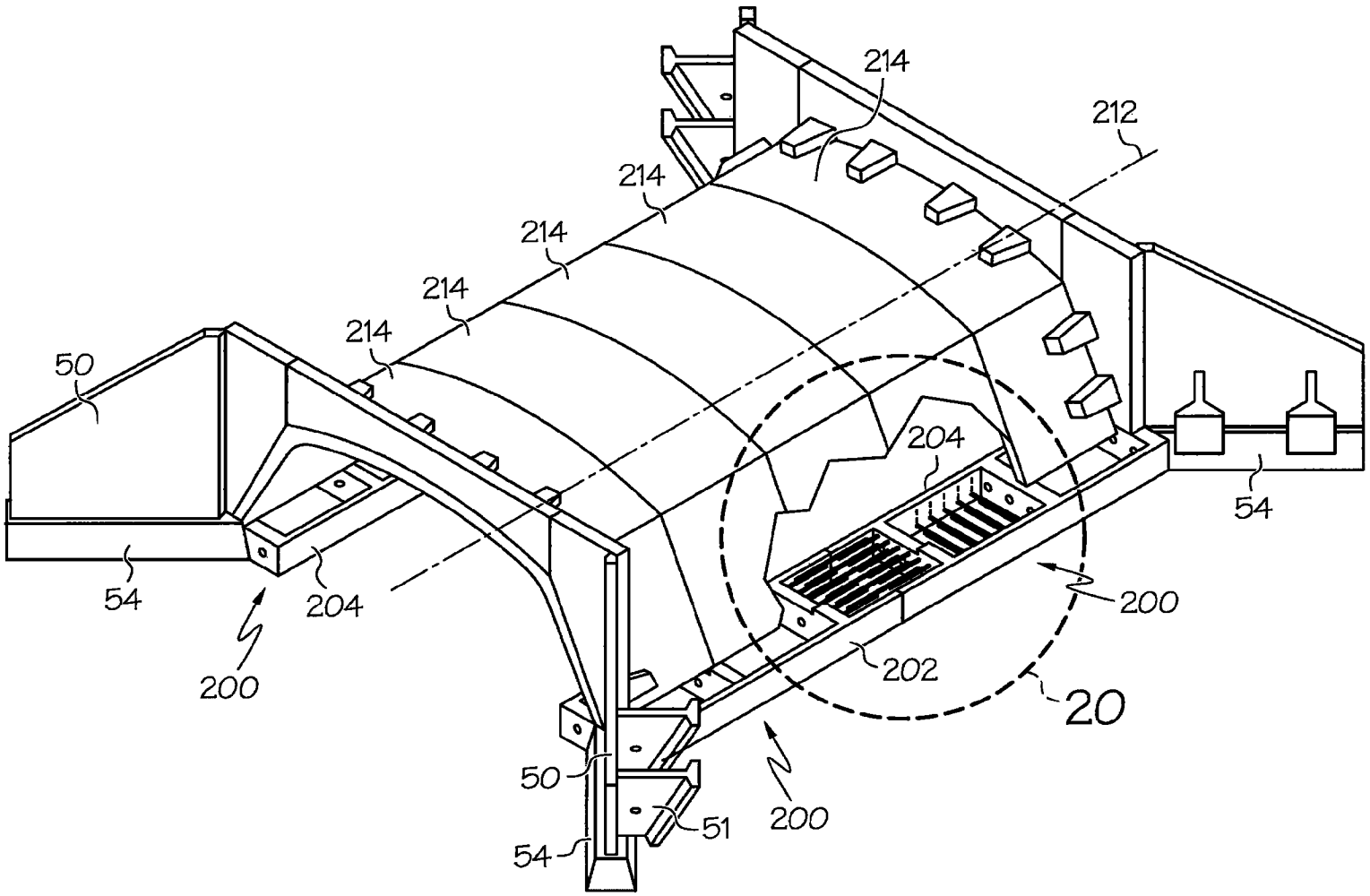
FIGS. 19-21 show a culvert assembly atop one embodiment of a foundation system.
Figure 20:
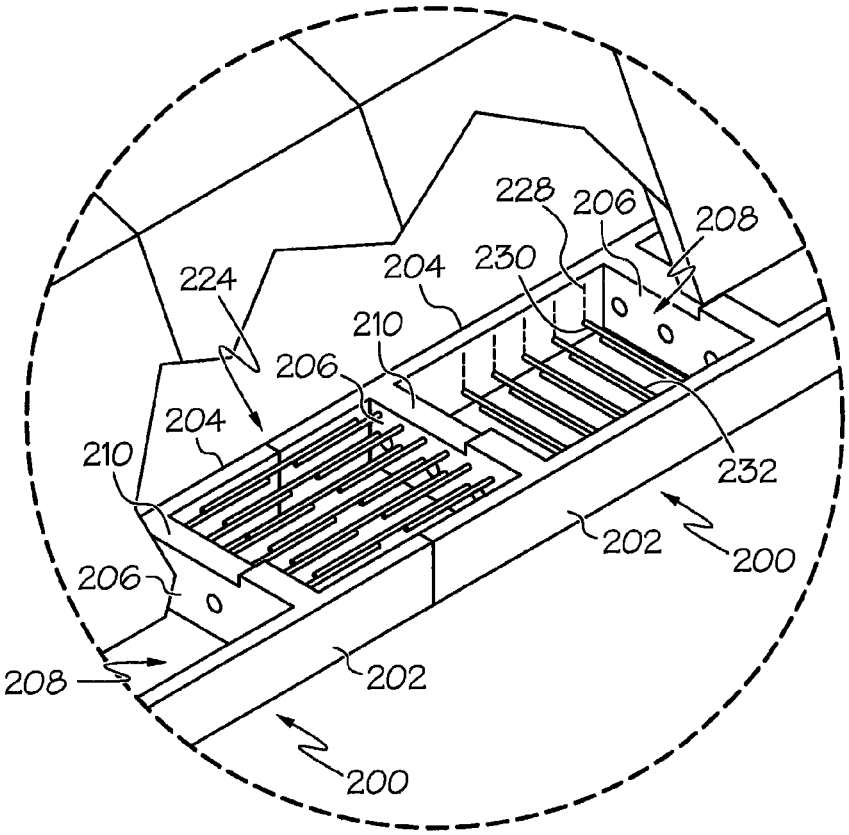
Figure 21:
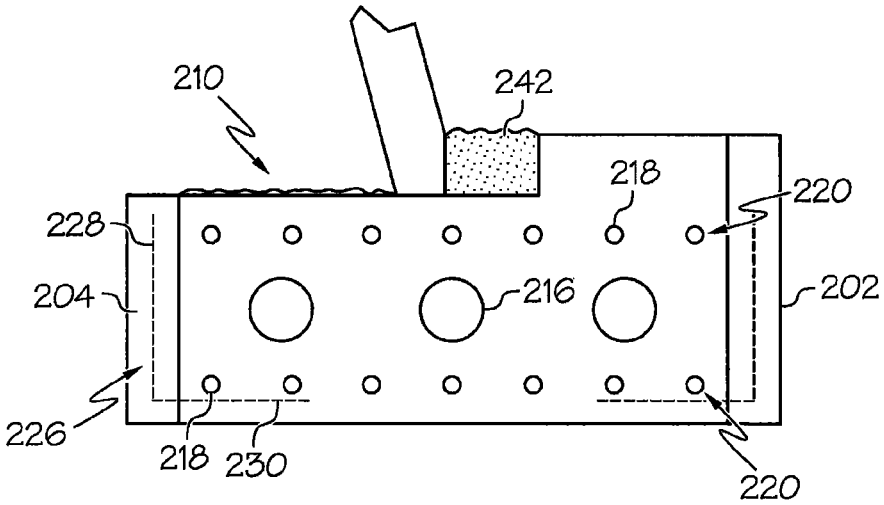

Referring now to FIGS. 19-21, in one embodiment the culvert sections are supported atop a foundation system having precast foundation units 200 with a ladder configuration as shown. The units have spaced apart and elongated upright walls 202 and 204 forming a channel 205 between the walls and cross-member supports 206 extending transversely across the channel to connect the walls 202 and 204. The foundation units 200 lacks any bottom wall, such that open areas or cells 208 extend vertically from the top to bottom of the units in the locations between the cross-members 206. Each cross-member support 206 includes an upper surface with a recess 210 for receiving the bottom portion of one side of the bridge/culvert sections 214. The side wall portions of the bridge units 214 extend from their respective bottom portions upwardly away from the combination precast and cast-in-place concrete foundation structure and inward toward the other combination precast and cast-in-place concrete foundation structure at the opposite side of the bridge unit. The recesses 210 extend from within the channel 205 toward the inner upright wall member 204, that is the upright wall member positioned closest to central axis 212 of the bridge system. Thus, as best seen in FIG. 35, the upright wall member 202 has a greater height than the upright wall member 204.

The spacing of the cross-members 208 preferably matches the depth of the bridge/culvert sections 214, such that adjacent end faces of the side-by-side bridge units abut each other in the vicinity of the recesses 210. Each cross-member support 206 also includes one or more larger through openings 216 for the purpose of weight reduction and allowing concrete to flow from one open area or cell 208 to the next. Each cross-member support also includes multiple axially extending reinforcement openings 218. An upper row 220 and lower row 222 of horizontally spaced apart openings 218 is shown, but variations are possible. Axially extending reinforcement may be extended through such openings prior to delivery of the foundation units 200 to the installation site, but could also be installed on-site if desired. These openings 218 are also used to tie foundation units 200 end to end for longer foundation structures. In this regard, the ends of the foundation units 200 that are meant to abut an adjacent foundation unit may be substantially open between the upright wall members 202 and 204 such that the abutting ends create a continuous cell 224 in which cast-in-place concrete will be poured. However, the far ends of the end foundation units 200 in a string of abutting units may typically include an end-located cross-member 206 as shown.

The walls 202 and 204 include reinforcement 226 that includes a portion 228 extending vertically and a portion 230 extending laterally into the open cell areas 208 in the lower part of the foundation unit 200. At the installation site, or in some cases prior to delivery to the site, opposing portions 230 of the two side walls can then be tied together by a lateral reinforcement section 232.

The precast foundation units 200 are delivered to the job site and installed on ground that has been prepared to receive the units (e.g., compacted earth or stone). The bridge/culvert sections 214 are placed after the precast foundation units are set. The cells 208 remain open and unfilled during placement of the bridge units 214 (with the exception of any reinforcement that may have been placed either prior to delivery of the units 200 to the job site or after delivery). Shims may be used for leveling and proper alignment of bridge/culvert sections 214. Once the bridge units 214 are placed, the cells 208 may then be filled with an on-site concrete pour. The pour will typically be made to the upper surface level of the foundation units 200. In this regard, and referring to FIG. 35, due to the difference in height of the respective sides of the foundation unit 200, the bottom portion 240 of the bridge unit will be captured and embedded within the cast-in-place concrete 242 at the outer side of bottom portion 240. After the on-site pour, the cast-in-place concrete at the outer side of the bottom portion 240 of the bridge unit is higher than a bottom surface of the bottom portion 240 to embed the bottom portion at its outer side, and the cast-in-place concrete at the inner side of the bottom portion of the bridge unit is substantially flush with the bottom surface of the bottom portion 240. In this manner, the flow area beneath the bridge units is not adversely impacted by embedment of the bottom portions 240 of the bridge units.

Figure 22:
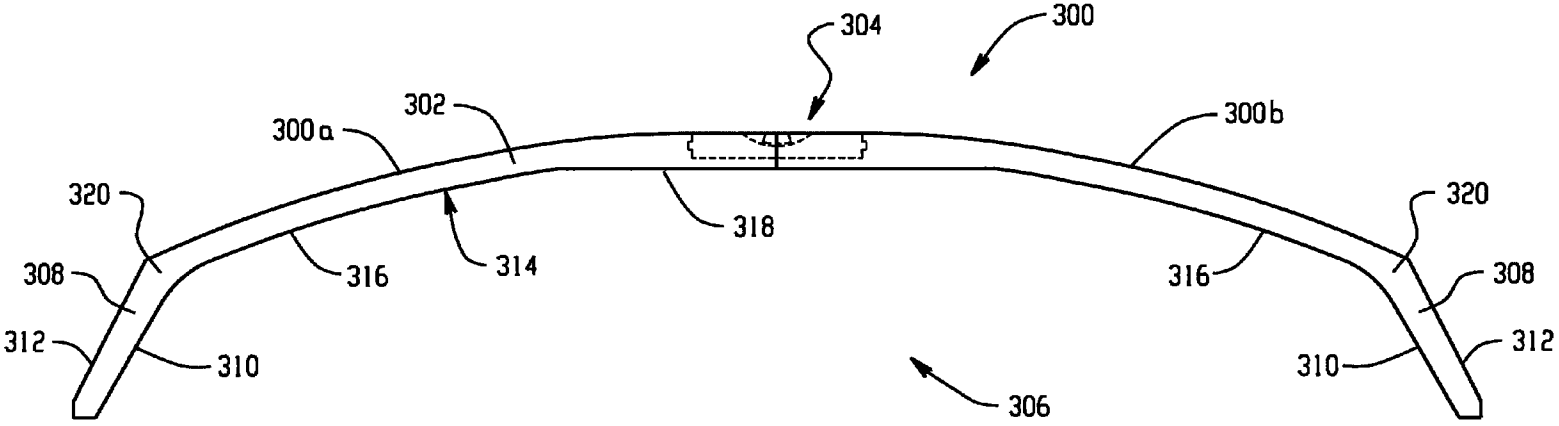
FIG. 22 shows a twin-leaf embodiment.

It is to be clearly understood that the above description is intended by way of illustration and example only and is not intended to be taken by way of limitation, and that changes and modifications are possible. For example, while haunch sections with curved inner surfaces and exterior corners are shown, variations are possible, such as flat inner surfaces and/or a chamfered or flat at the exterior corner. Also, embodiments in which the side walls are not tapered are possible. Moreover, twin leaf embodiments are contemplated, in which the each concrete culvert section is formed by two halves having a joint (e.g., per dashed line 180 in FIG. 16) at a central portion of the top wall of the culvert section. Various joint types could be used, such as that disclosed in U.S. Pat. No. 6,243,994. More specifically, and referring to FIG. 22, a twin leaf system in which each twin leaf culvert section 300 is made up of leaf halves 300*a* and 300*b* that abut at the center of the top wall 302 with a concrete and steel reinforced joint 304 of the type disclosed in U.S. Pat. No. 6,243,994. One leaf section 300 is shown in the end elevation view of FIG. 22, it being understood that in a typical installation multiple instances of similar sections would be aligned behind the one illustrated, in a manner similar to that shown for the embodiments described above. Each twin leaf culvert section 300 includes an open bottom 306, a top wall 304 and spaced apart side walls 308 to define a passage thereunder. Each side wall 308 extends downward and outward from the top wall 302 and has a substantially planar inner surface 310 and a substantially planar outer surface 312. The top wall 302 has an arch-shaped inner surface 314 with curved side sections 316 and an interior joint section 318 that is generally planar. Haunch sections 320 join the side walls 308 to the top wall 302. The various relationships between the top wall, haunch sections, and side walls may be similar to those previously mentioned above. As above, each side wall 308 is tapered from top to bottom such that a thickness of each side wall decreases when moving from the top of each side wall to the bottom of each side wall. Likewise, the outer surface 312 includes a vertical flat at its bottom end.

Figure 23:
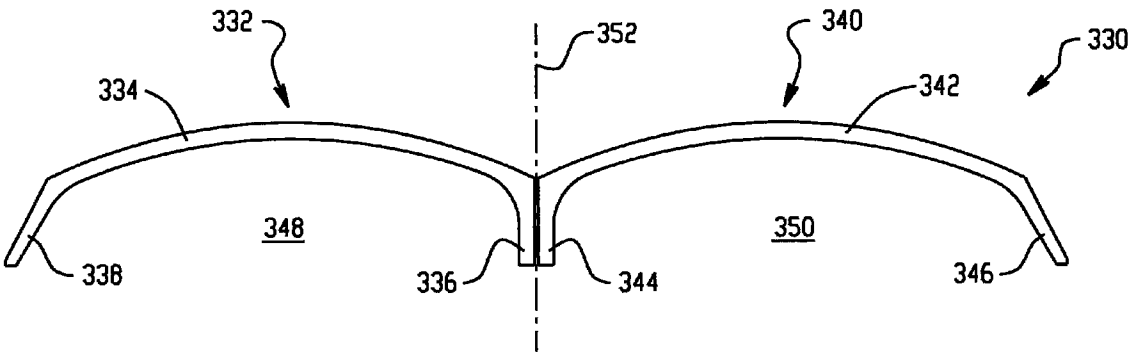
FIGS. 23 and 24 show embodiments of multi-channel culvert assemblies.
Figure 24:
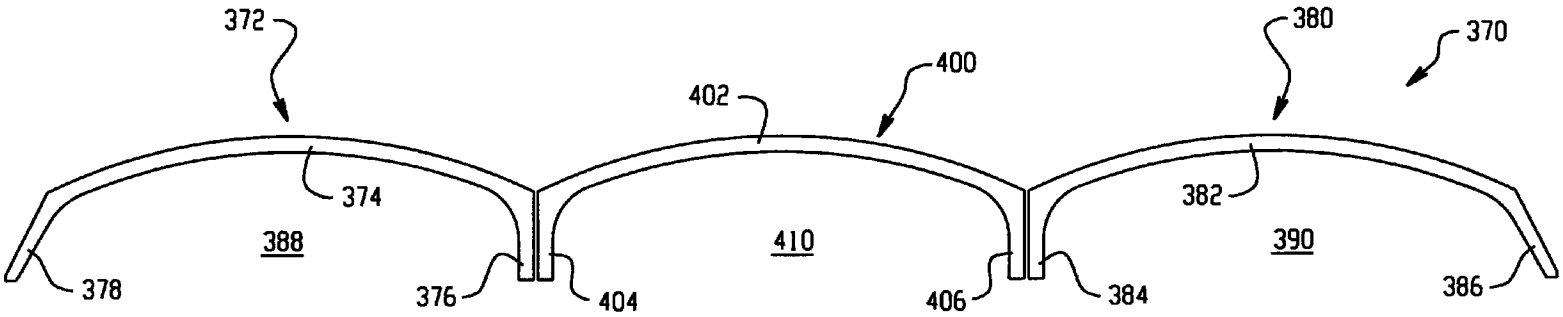

Referring now to FIGS. 23 and 24, multi-channel culvert assemblies are shown in end elevation view, it again being recognized that in a typical installation multiple instances of the culvert units would be aligned behind the ones illustrated, according to the desired length of the overall structure. FIG. 23 shows a two channel embodiment 330, and FIG. 23 shows a three channel embodiment 370, but more than three channels could be provided. Each illustrated multi-channel culvert assembly includes one culvert uniting 332, 372 having an arch-shaped top wall 334, 374, one side wall 336, 376 extending substantially vertically downward from the top wall and a another sidewall 338, 378 extending downward and outward from the top wall. The configuration and orientation of the angled sidewall 338, 378 may be similar to that described above for the embodiments with two angled side walls. Another culvert unit 340, 380 has an arch-shaped top wall 342, 382, a side wall 344, 384 extending substantially vertically downward from the top wall and another sidewall 346, 386 extending downward and outward from the top wall. Again, the configuration and orientation of the angled sidewall 346, 386 may be similar to that described above for the embodiments with two angled side walls. Culvert unit 332, 372 is positioned with its vertical side wall 336, 376 toward an inner part of the assembly and culvert unit 340, 380 is positioned with its vertical side wall 344, 384 toward an inner side of the assembly to create first (348, 388) and second (350, 390) channels of the assembly. Each channel has an inner side that is substantially vertical and an outer side that is angled from vertical.

In the assembly 330 of FIG. 23, side wall 336 of culvert unit 332 is positioned adjacent the side wall 344 of the culvert unit 340, and the two culvert units 332 and 340 are identical in shape and size, but arranged in mirror image orientation about a vertical axis 352 between the two units.

In the assembly 370 of FIG. 24, an intermediate culvert unit 400 is positioned between the culvert units 372 and 380. The intermediate culvert unit includes an arch-shaped top wall 402, and opposite side walls 404, 406 both of which extend substantially vertically downward from the top wall. The intermediate culvert unit 400 forms an intermediate channel 410 located between the channels 388 and 390. Although a single intermediate culvert unit 400 is shown, it is recognized that two or more intermediate culvert units 400 could be placed between the two culvert units 372 and 380 to provide two or more intermediate channels. The intermediate culvert units would typically be of identical shape and size, though variations are possible. Likewise, the culvert units 372 and 380 would typically be of identical in shape and size, with opposite orientations, though variations are possible.

It is recognized that one or more units used in the culvert assemblies of FIGS. 23 and 24 could be formed as twin leaf culvert sections with top joints, including one leaf section in which the side wall is substantially vertical and another leaf section in which the side wall is outwardly angled.

While one embodiment of a foundation system is shown, the culvert assembly could be placed atop any suitable foundation, including foundation systems with pedestal structures. Accordingly, other embodiments are contemplated and modifications and changes could be made without departing from the scope of this application.

What is claimed is:

1. A multi-channel culvert assembly, comprising:

a first culvert unit having an arch-shaped top wall, a first side wall extending substantially vertically downward from the top wall and a second sidewall extending downward and outward from the top wall;

a second culvert unit having an arch-shaped top wall, a first side wall extending substantially vertically downward from the top wall and a second sidewall extending downward and outward from the top wall;

wherein the first culvert unit is positioned with its first side wall toward an inner part of the assembly and the second culvert unit is positioned with its first side wall toward the inner part of the assembly to create first and second channels of the assembly, the first channel beneath the first culvert unit, the second channel beneath the second culvert unit, wherein the first channel has an inner side that is substantially vertical and an outer side that is angled from vertical and the second channel has an inner side that is substantially vertical and an outer side that is angled from vertical.

2. The multi-channel culvert assembly of claim 1 wherein a surface of the first side wall of the first culvert unit is positioned adjacent a surface of the first side wall of the second culvert unit.

3. The multi-channel culvert assembly of claim 2 wherein the first culvert unit and the second culvert unit are identical in shape and size.

4. The multi-channel culvert assembly of claim 1 wherein at least one intermediate culvert unit is positioned between the first culvert unit and the second culvert unit, the intermediate culvert unit including an arch-shaped top, a first side wall extending substantially vertically downward from the top wall and a second side wall extending substantially vertically downward from the top wall, the intermediate culvert unit forming an intermediate channel located between the first channel and the second channel, both sides of the intermediate channel being substantially vertical.

5. The multi-channel culvert assembly of claim 4 wherein the first side wall of the first culvert unit is located adjacent to and in contact with the first side wall of the intermediate culvert unit, and the first side wall of the second culvert unit is located adjacent to and in contact with the second side wall of the intermediate culvert unit.

6. The multi-channel culvert assembly of claim 4 wherein multiple intermediate culvert units are positioned between the first culvert unit and the second culvert unit, the first culvert unit and the second culvert unit are identical in shape and size but have opposite orientations, the multiple intermediate culvert units each have the same shape and size.

7. The multi-channel culvert assembly of claim 4 wherein multiple intermediate culvert units are positioned between the first culvert unit and the second culvert unit, wherein the first side wall of the first culvert unit is located adjacent to and in contact with one side wall of a first of the intermediate culvert units, and the first side wall of the second culvert unit is located adjacent to and in contact with one side wall of a second of the intermediate culvert units.

8. The multi-channel culvert assembly of claim 1 wherein at least one of the first culvert unit or the second culvert unit is formed as a twin-leaf culvert unit with top joint securing together a pair of leaf sections of the twin leaf culvert unit.

9. A multi-channel culvert assembly, comprising:

a first culvert unit having an arch-shaped top wall, a first side wall extending substantially vertically downward from the top wall and having substantially parallel inner and outer surfaces, and a second sidewall extending downward and outward from the top wall and having non-parallel inner and outer surfaces whereby the second sidewall is tapered from top to bottom such that a thickness of the second side wall decreases when moving from top to bottom;

a second culvert unit having an arch-shaped top wall, a first side wall extending substantially vertically downward from the top wall and having substantially parallel inner and outer surfaces, and a second sidewall extending downward and outward from the top wall and having non-parallel inner and outer surfaces whereby the second sidewall is tapered from top to bottom such that a thickness of the second side wall decreases when moving from top to bottom;

wherein the first culvert unit is positioned with its first side wall toward an inner part of the assembly and the second culvert unit is positioned with its first side wall toward the inner part of the assembly to create first and second channels of the assembly, the first channel beneath the first culvert unit, the second channel beneath the second culvert unit, wherein the first channel has an inner side that is substantially vertical and an outer side that is angled from vertical and the second channel has an inner side that is substantially vertical and an outer side that is angled from vertical.

10. The multi-channel culvert assembly of claim 9 wherein a surface of the first side wall of the first culvert unit is positioned adjacent a surface of the first side wall of the second culvert unit.

11. The multi-channel culvert assembly of claim 9 wherein at least one intermediate culvert unit is positioned between the first culvert unit and the second culvert unit, the intermediate culvert unit including an arch-shaped top, a first side wall extending substantially vertically downward from the top wall and a second side wall extending substantially vertically downward from the top wall, the intermediate culvert unit forming an intermediate channel located between the first channel and the second channel, both sides of the intermediate channel being substantially vertical.

12. The multi-channel culvert assembly of claim 11 wherein the first side wall of the first culvert unit is located adjacent to and in contact with the first side wall of the intermediate culvert unit, and the first side wall of the second culvert unit is located adjacent to and in contact with the second side wall of the intermediate culvert unit.

13. The multi-channel culvert assembly of claim 11 wherein multiple intermediate culvert units are positioned between the first culvert unit and the second culvert unit, wherein the first side wall of the first culvert unit is located adjacent to and in contact with one side wall of a first of the intermediate culvert units, and the first side wall of the second culvert unit is located adjacent to and in contact with one side wall of a second of the intermediate culvert units.

* * * * *